US008834329B2

(12) United States Patent
Kelly

(10) Patent No.: US 8,834,329 B2
(45) Date of Patent: Sep. 16, 2014

(54) BENCH PRESS COMBINING FULL BODY SAFETY BARS AND GLIDING BAR HOLDER ARMS

(71) Applicant: Sean Kelly, Miami Beach, FL (US)

(72) Inventor: Sean Kelly, Miami Beach, FL (US)

( * ) Notice: Subject to any disclaimer, the term of this patent is extended or adjusted under 35 U.S.C. 154(b) by 54 days.

(21) Appl. No.: 13/732,429

(22) Filed: Jan. 2, 2013

(65) Prior Publication Data

US 2014/0187391 A1 Jul. 3, 2014

(51) Int. Cl.
*A63B 21/072* (2006.01)
*A63B 21/078* (2006.01)
*A63B 21/00* (2006.01)

(52) U.S. Cl.
CPC ..... *A63B 21/00047* (2013.01)
USPC ..... 482/104; 482/92; 482/106

(58) Field of Classification Search
USPC ..... 482/142, 93–104
See application file for complete search history.

(56) References Cited

U.S. PATENT DOCUMENTS

| | | | | | |
|---|---|---|---|---|---|
| 4,635,930 | A * | 1/1987 | Cormier | 482/104 |
| 4,648,595 | A * | 3/1987 | Selle | 482/104 |
| 4,799,673 | A | 1/1989 | Selle | |
| 4,861,025 | A * | 8/1989 | Rockwell | 482/142 |
| 4,949,959 | A * | 8/1990 | Stevens | 482/104 |
| 5,082,259 | A * | 1/1992 | Gonzalez | 482/41 |
| 5,141,480 | A * | 8/1992 | Lennox et al. | 482/104 |
| 5,281,193 | A * | 1/1994 | Colbo, Jr. | 482/104 |
| 7,591,771 | B2 | 9/2009 | Rullestad et al. | |
| 7,798,944 | B2 * | 9/2010 | Suber et al. | 482/104 |
| 8,066,622 | B2 | 11/2011 | Kim | |
| 2010/0130335 | A1 | 5/2010 | Hoobler | |

* cited by examiner

*Primary Examiner* — Stephen Crow
(74) *Attorney, Agent, or Firm* — Nasser Ashgriz

(57) ABSTRACT

A bench press and a power rack system having a combination of moving uprights to hold a barbell and safety arms to prevent dropping of the barbell on the user's body. The moving uprights being in the same plane as the safety arms and move inside them to provide maximum freedom for the users arms during the exercise, while protecting users entire upper body.

20 Claims, 16 Drawing Sheets

(a)

(b)

(a)

(b)

BENCH PRESS COMBINING FULL BODY SAFETY BARS AND GLIDING BAR HOLDER ARMS

FIELD OF THE INVENTION

The present invention relates to a bench press having novel safety arms in combination with moving uprights which hold a barbell.

BACKGROUND AND SUMMARY OF THE INVENTION

Exercise equipment are responsible for a large number of injuries every year, some being fatal. A bench press is one of those exercise equipment that is notorious for causing serious injuries as the users try to lift very heavy weight. A conventional bench press comprises of a bench and a set of uprights with racks to hold a barbell. A user lies down on the bench, lifts the barbell off the upright racks, and repeatedly lowers the barbell towards the chest and then pushes it back up until the arms are straight. At the end of the exercise, the user puts the barbell back on the racks. If, at any time during this exercise, the user cannot properly control the barbell, it may fall on the user's face, neck, chest, or abdomen, resulting in serious bodily injuries and even asphyxiation. To prevent such accidents, especially when using heavier weights, users usually have one or two spotters to help them put the barbell back on the racks.

The prior art provides several different bench presses to prevent such accidents. For example, the U.S. Patent application No. 2010/0130335 A1 by Hoobler and U.S. Pat. No. 7,591,771 B2 issued to Rullestad et al. disclose two different bench presses having safety features. However, the prior art bench presses that have some sort of safety means limit user's movement and the space in which the user can exercise. The safety features have to be located within the grip length of a barbell. The grip length is about 1.31 meter (4.3 feet or 51.6 inches), which provides a defined space in which the safety features have to be located. However, the safety features in the prior art are located in much smaller distances than 51.6 inches. This limits user's arm movement during the exercise. To alleviate this problem, in some devices the barbell is suspend from the top. All such safety features modify the basic use of a bench press and do not necessarily allow for a user to lift the weight correctly, unencumbered and freely. As such, they are not well received by many users who prefer using standard bench presses without significant alterations. The presently provided bench press allows for a safe, an unencumbered and correct use of a bench press with free weights.

SUMMARY OF THE INVENTION

The present invention is a bench press with novel safety features to protect a user's entire body in case the weight lifting barbell is accidentally dropped.

To begin the exercise, a user lies on the bench and positioned his or her body underneath the barbell, such that the barbell as held on a set of holding racks, is directly over the user's head. The first step in performing the bench press exercise is to move the barbell away from its supporting rack. In a conventional bench press, the supporting rack is fixed in space, therefore, the user has to reach slightly backwards towards the head to grab the barbell has held on the supporting racks and then glide it forward to a substantially vertical position. To lift a heavy weight with arms tilted backward may result in mishandling of the weight. This initial movement of the barbell can be dangerous since the shoulder muscles are put in a precarious and weak position. During this initial movement, the larger pectoral and triceps muscles are involved. Since the barbell is right over user's face, neck, and upper chest, serious injuries may occur if there is a muscle failure or other accidents. To prevent such injuries at the beginning of the exercise, very heavy weight lifters use spotters to manually assist the user with this movement, lifting the barbell away from the holding racks and into the starting position above the high point of the chest. Spotters are also used in case the user loses control of the bar during this initial movement or loses muscular control of the bar, such that they may attempt to catch the bar before it can fall onto the user causing injury or even death.

The present invention facilitates and addresses the above issues by incorporating moving uprights. The uprights move backward and out of the way as soon as the barbell is lifted off the supporting racks. In the present device, the user can glide forward the barbell while it is on the holding racks. The user may then simply lift the bar directly up and off the racks. The holding racks are then retracted by a counter weight mechanism, allowing the user to complete the bench press exercise without any undue muscle exertions.

Therefore, the present bench press is invented to achieve the following objectives. The first object of the present invention is to provide a bench press that can be safely used by a user without any need for "spotters".

The second object of the present invention is to provide a bench press that allows the user to vertically lift the barbell off its racks, eliminating possibility of shoulder injury during the initial lifting.

The third object of the present invention is to provide a bench press with safety features which are spaced such that they do not interfere with the correct execution of the users' bench press exercise.

The fourth object of the present invention is to provide a bench press having a set of safety arms spaced at the same distance as the grip length of a barbell, allowing for an unrestricted movement of the arms during the exercise.

The aforementioned objects of the present invention are attained by a secured bench press having movable barbell supporting uprights and horizontal safety arm. Other objects, advantages and novel features of the present invention will become readily apparent from the following drawings and detailed description of preferred embodiments.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION OF PREFERRED EMBODIMENTS

Figure 1:
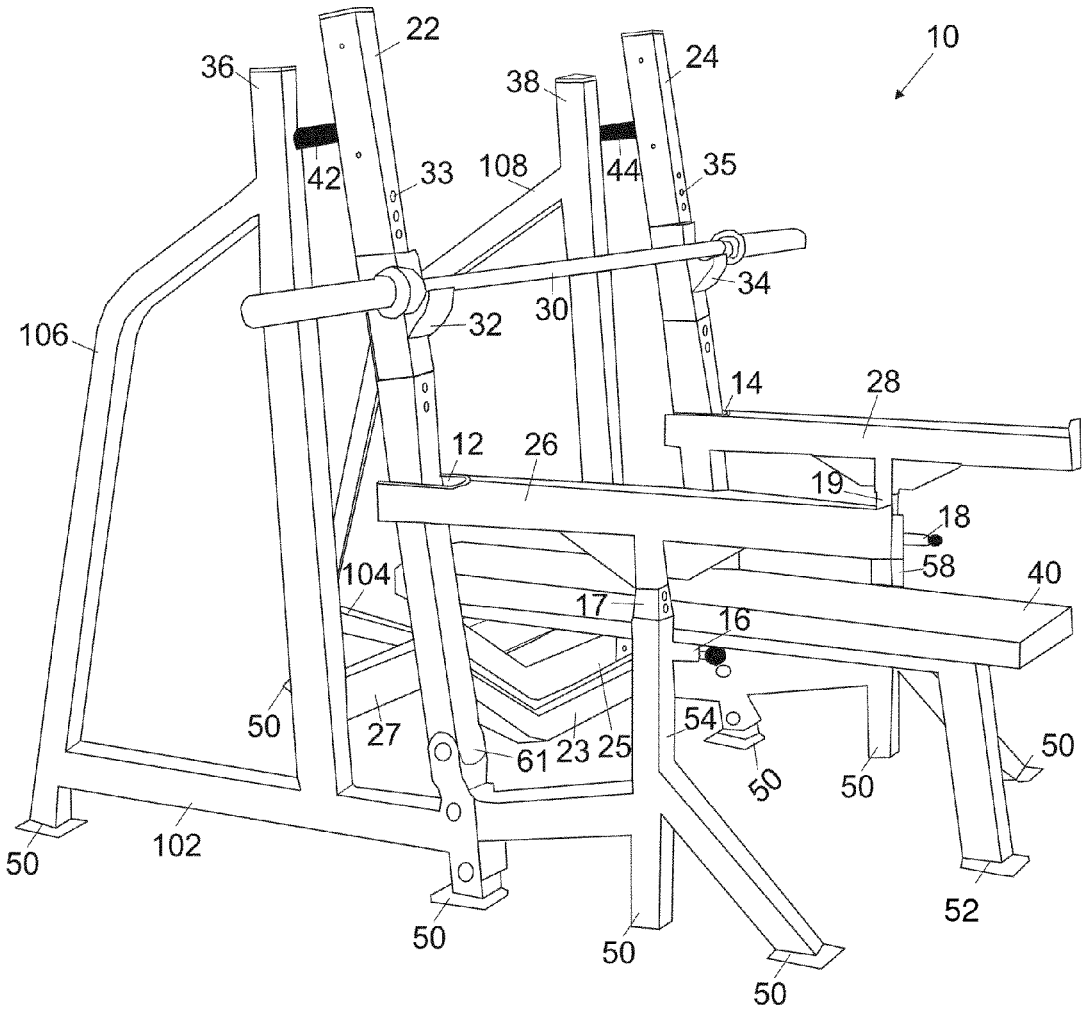
FIG. 1 shows the one embodiment of the present bench press in a normal non-active position.

Referring to FIG. 1, a bench press 10, having a stand with a right and a left longitudinally extended horizontal beams 102 and 104, and multiplicity of ground engaging legs 50, to stably support the whole device on the ground. The width of the stand is within the grip length of the barbell. Conventional barbells have a grip length of 51.6 inches. Therefore, in one embodiment of the present system, the width of the stand is 50 inches, just shy of the grip length of a conventional barbell. The small difference of 1.6 inches is provided to allow for installing two holding racks to hold the barbell. Wider stands can be built for longer grip length barbells.

The stand further comprises of two stationary vertical beams, 36, 38, each rigidly connected to the longitudinally extended horizontal beams 102 and 104. Reinforcing beams 106 and 108 are used to add to the rigidity of the stand. The reinforcing beams extend from the far lower back of the stand to the top of the stationary vertical beams. A first cross beam 27 connects the two stationary vertical beams 36 and 38 to provide more rigidity and also to provide a support for one end of the bench 40 that the user lays on when doing the exercise. Two moving uprights 22, 24 are pivoted, 61 and 62, to the stand 102 and 104. The moving uprights are located in front of and substantially parallel to the stationary beams 36, 38. A second set of cross beams 23 and 25 connect the two moving uprights 22 and 24 to provide rigidity and to act as counter weight for the moving uprights. The bench 40 is located longitudinally in between the right and the left vertical beams. One end of bench 40 is adjustably connected to the cross beam 27. The other end of the bench has a leg 52. The height of the leg 52 is in accordance with the height of the bench of conventional bench presses.

Figure 2:
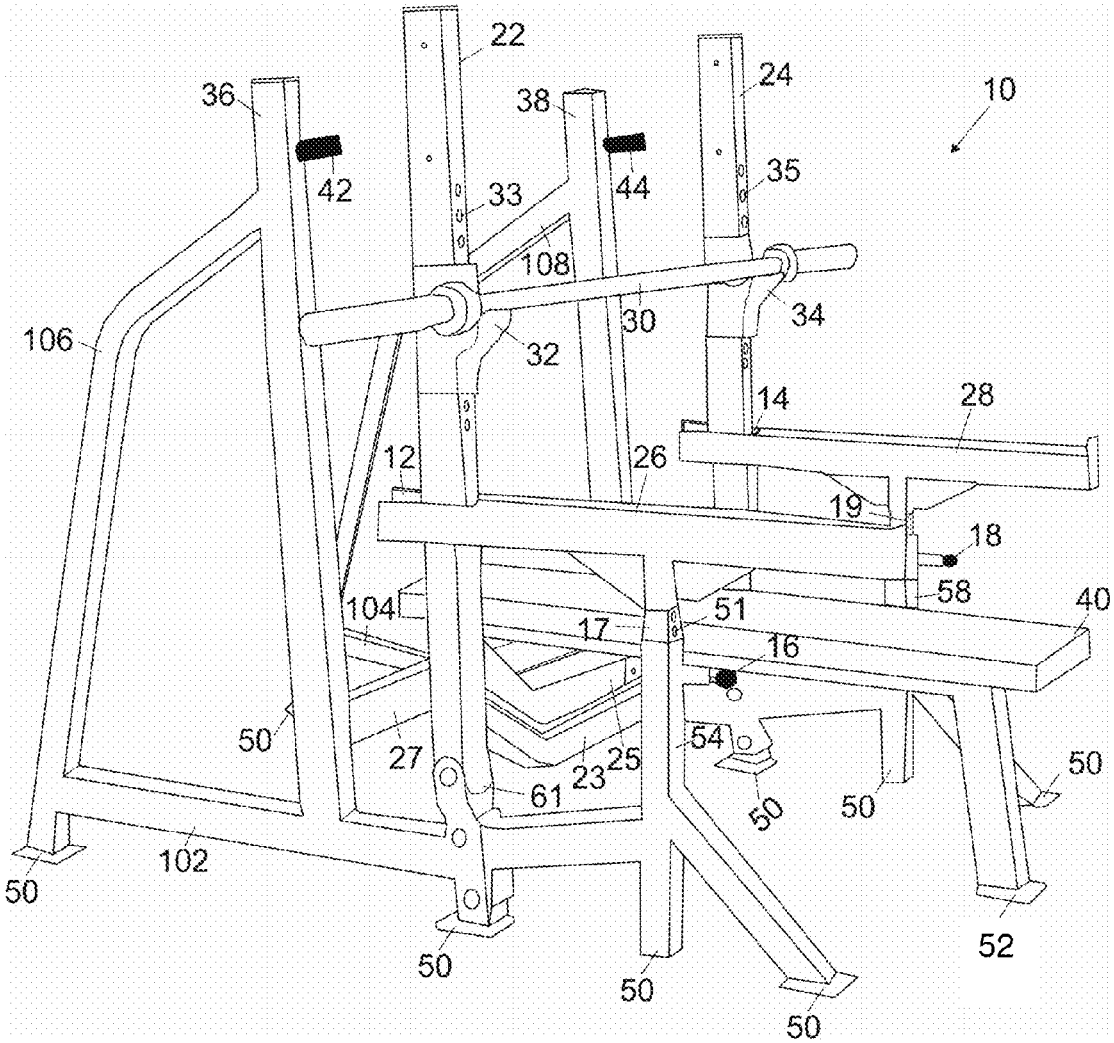
FIG. 2 shows the one embodiment of the present bench press in a lifting position.
Figure 3:
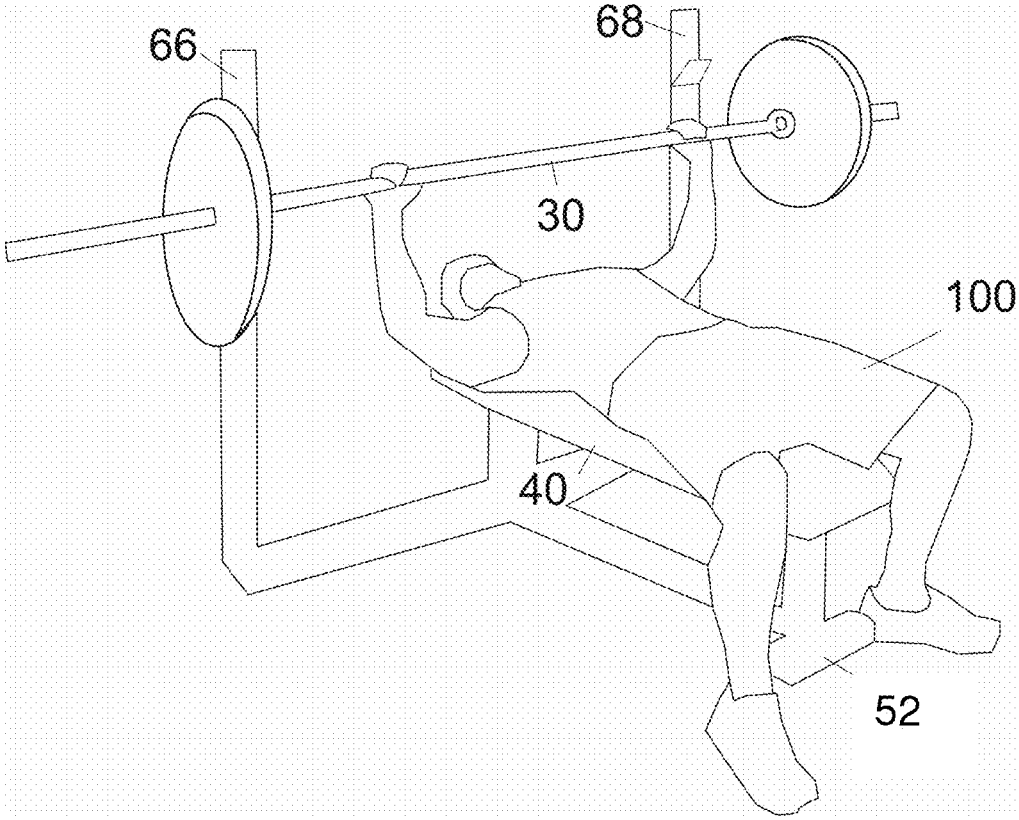
FIG. 3 shows a conventional prior art bench press.

The two moving uprights 22 and 24 have a set of racks 32 and 34 to hold a barbell 30. The location of the racks on the moving uprights can be adjusted using pin holes 33 and 35 on which the racks 32 and 34 are placed. Referring to FIGS. 1 and 2, the user can adjust the height of the barbell 30 by moving the racks 32 and 34 and lock them in position using different pinholes 33 and 35.

The moving uprights 22 and 24 together with their cross beams 23 and 25, which act as counter weights are designed such that their center of gravity provides a backward tilt as illustrated in FIG. 1. Once the user lies down on the bench 40, he/she can easily glide the barbell forward, tilting the upright to a lifting position. This would allow the user to lift the barbell vertically upward minimizing over exertion on the upper body and allowing for the safe initial lifting of the barbell off the racks. As soon as the user lifts the barbell, the counter weight systems 23 and 25 tilt the uprights backward moving the racks away from the barbell to allow for the user to lower the barbell towards his/her chest. Therefore, the bench press exercise may be performed unencumbered by the moving uprights 22 and 24 and the holding racks 32 and 34.

Two horizontally and longitudinally extending safety arms 26 and 28 are used to prevent accidental fall of the barbell 30, onto the user. The height of the horizontal safety arms 26, 28, is adjusted by the user to make sure that if the bar 30 drops during the exercise, it does not touch the user. The heights adjustment is achieved with a set of adjustable pins 16 and 18. A set of telescoping legs 17 and 19 connected to the floor legs 54 and 58 are used to facilitate the height adjustment. Users can adjust the height of the horizontal safety arms 26 and 28 to slightly above their maximal chest height when they are laying down on the bench.

One novelty of the present bench press is that the two longitudinally extending horizontal safety arms 26 and 28 are positioned on the same plane as those of the moving uprights. Therefore, the available space between the safety arms is about the same as the grip length of the barbell.

In order to have the uprights and the safety arms in the same vertical planes, and have almost the same spacing between the two safety arms as that of the two holding racks of the barbell, the moving uprights are allowed to move inside the safety arms. The safety arms have to be long enough to protect the upper body of a user, therefore, they have to extend beyond uprights holding the barbell. In the prior art, this is achieved by locating the safety arms inside the spacing between the two uprights. This limits user's arm movement. In the present bench press, the uprights are allowed to move inside the supporting arms by providing a U-shaped opening, 12 and 14, at one end of the safety arms. The U-shaped openings allow the safety beams to be extended passed the moving uprights without interfering with their movement.

Figure 4:
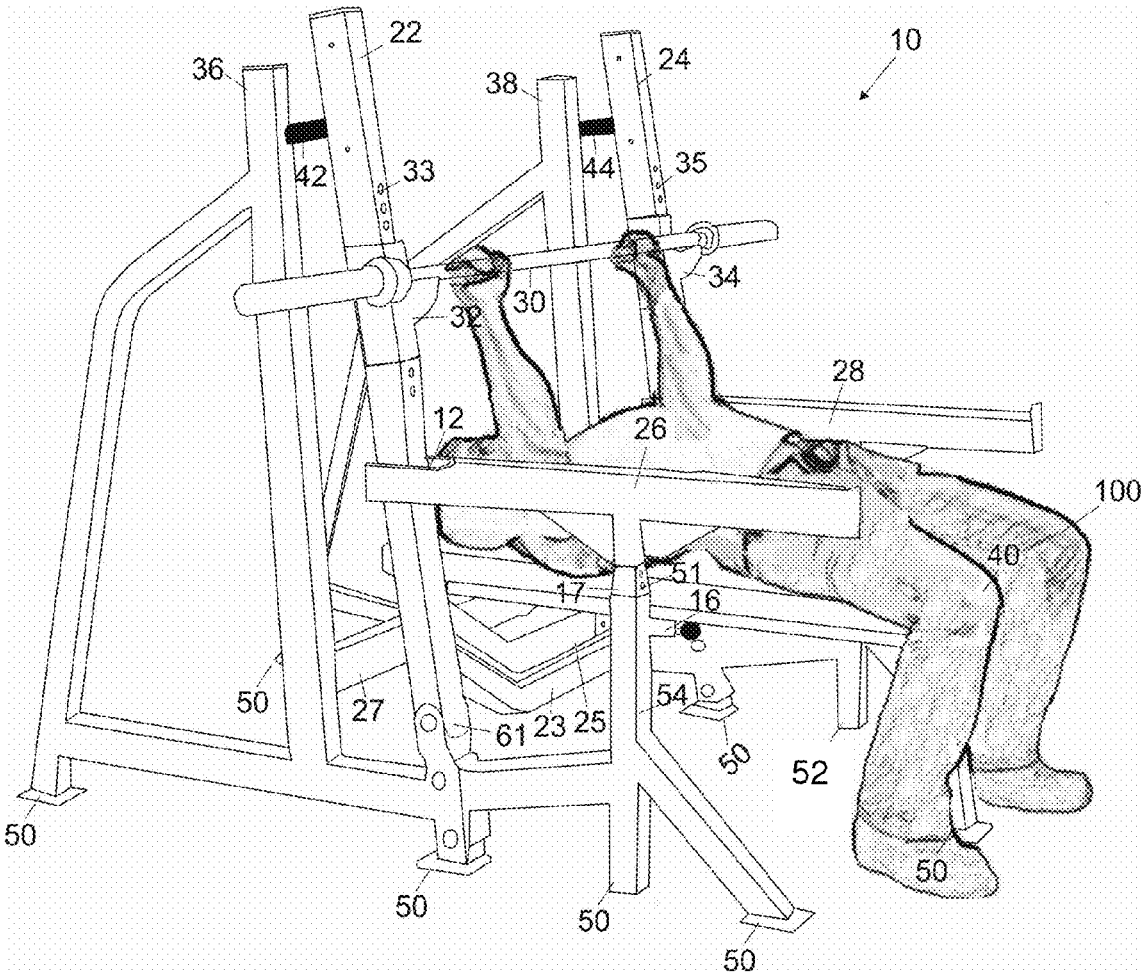
FIG. 4 shows a user grabbing the barbell and ready to move it forward to a lifting position.
Figure 5:
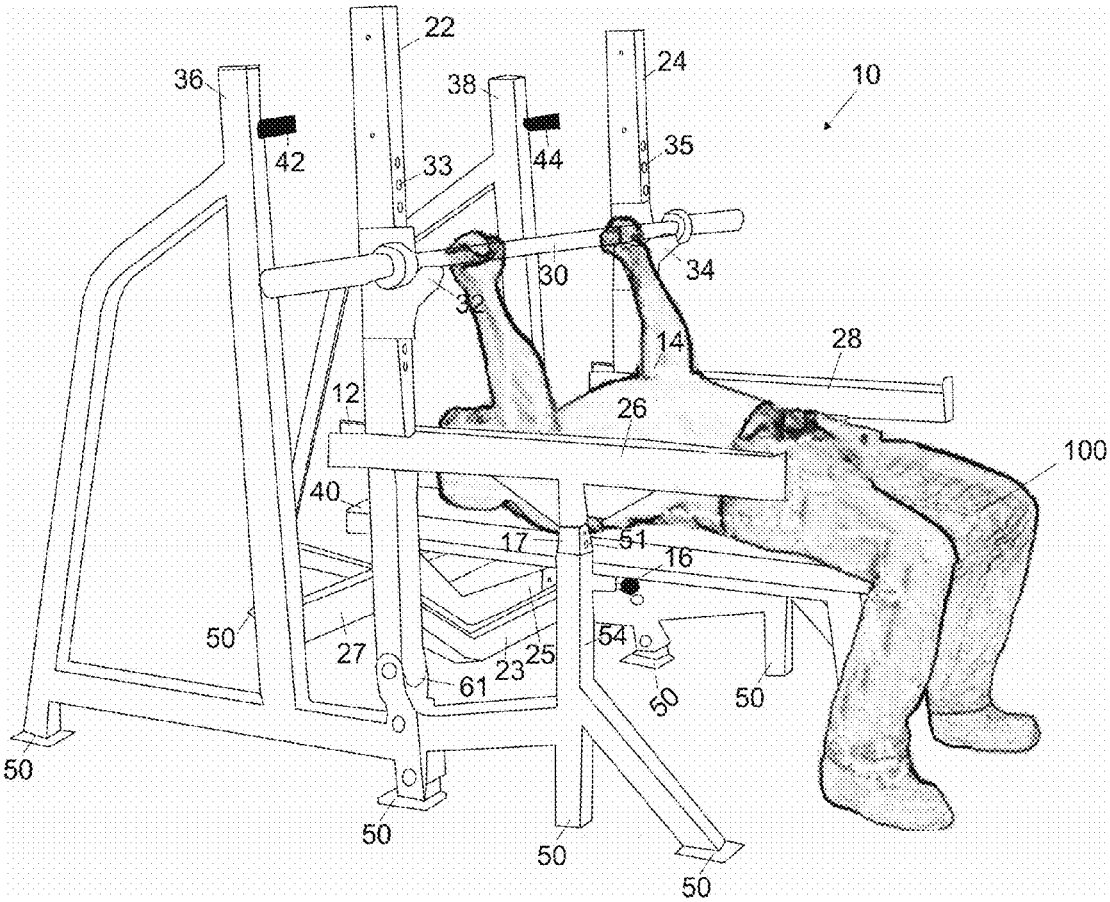
FIG. 5 shows a user who has glided the barbell forward to the lifting position.
Figure 6:
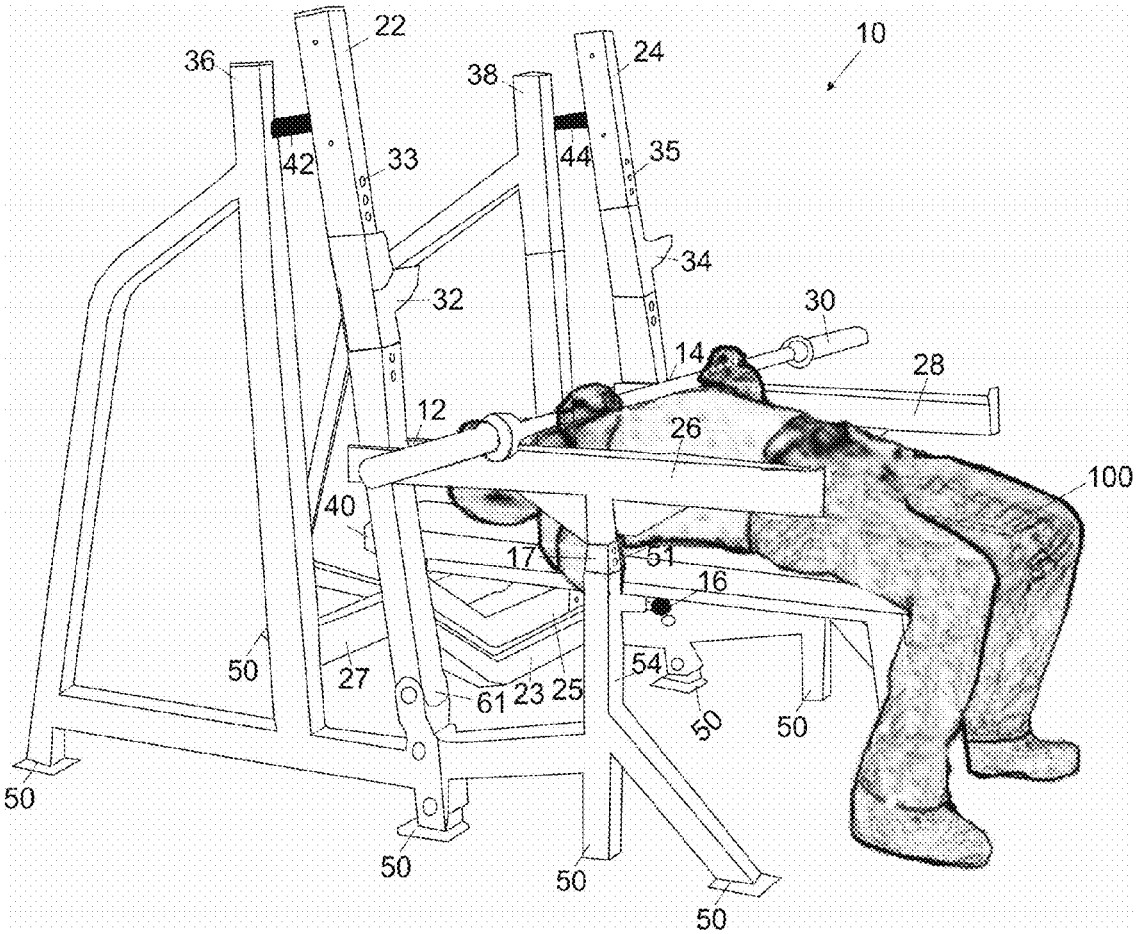
FIG. 6 shows the barbells on the safety arms.

FIGS. 4, 5 and 6 illustrate the steps a user may take to use the present bench press 10. A user 100 would lie on the bench 40 and adjust the position of his/her body on the bench such that his/her arms are positioned under the barbell. Once the user grabs the barbell 30 and lifts it slightly off the holding racks 32 and 34, the moving uprights would tilt backward moving the racks away from the barbell. The user can then move the barbell up and down for bench press and weight training.

Figure 9:
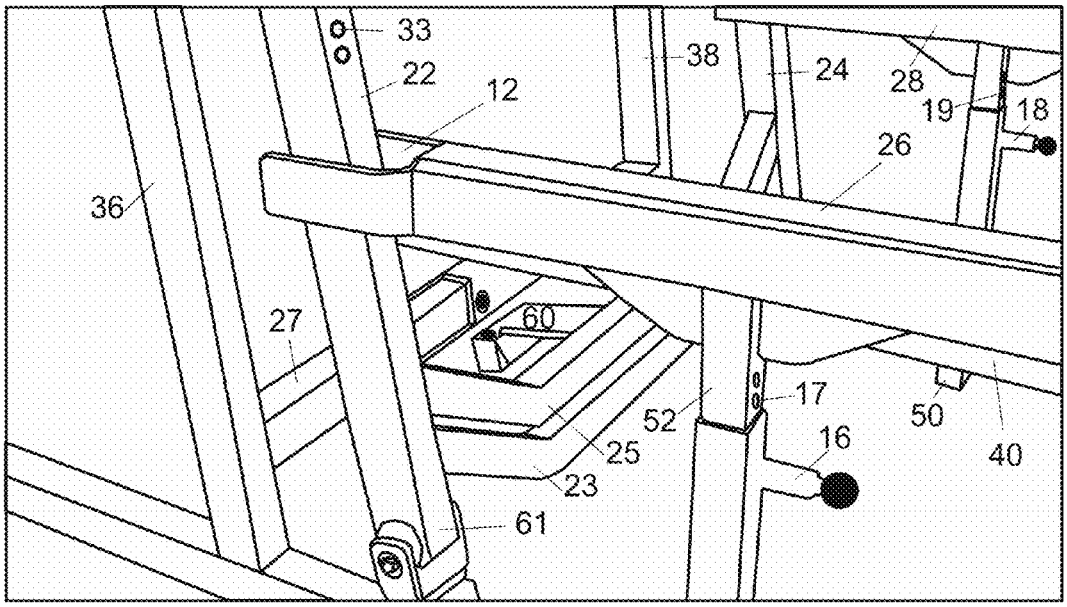
FIG. 9 shows enlarged partial schematic view of a movable upright and the safety arm in the non-lifting position.

A stopper 60 as shown in FIG. 9, which is attached to the cross bar 25 is used to limit the movement of the moving uprights in the forward direction and also provides a counter weight to assist in the return of the moving uprights from a near vertical position, back to their resting position. A set of rubber stopper 42 and 44 attached to the stationary beams 36 and 38 limit the backward movement of the moving uprights 22 and 24.

Figure 7:
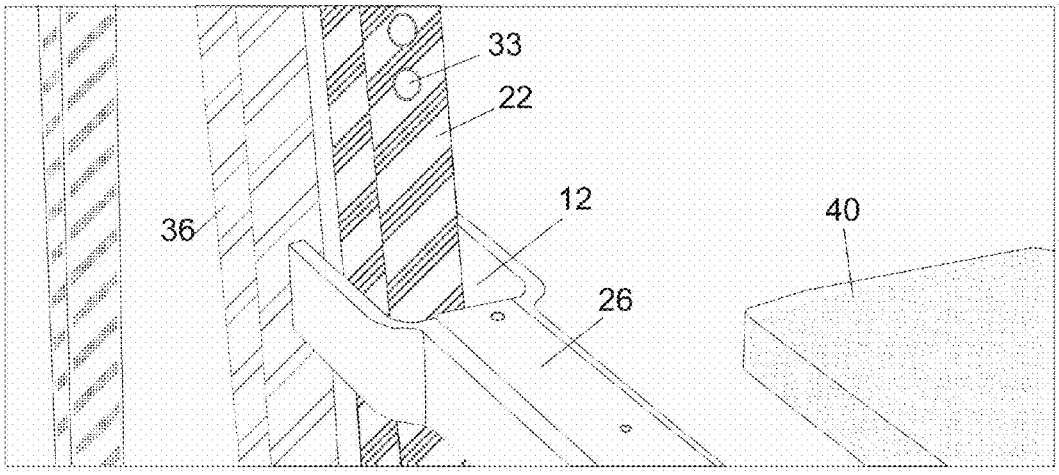
FIG. 7 shows an enlarged partial schematic view of a movable upright and a U-shaped end section of the supporting safety arm allowing for the upright to move to a proper lifting position.
Figure 7:
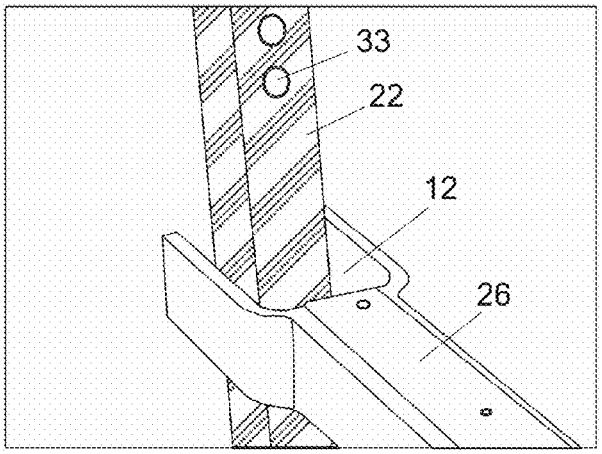
Figure 8:
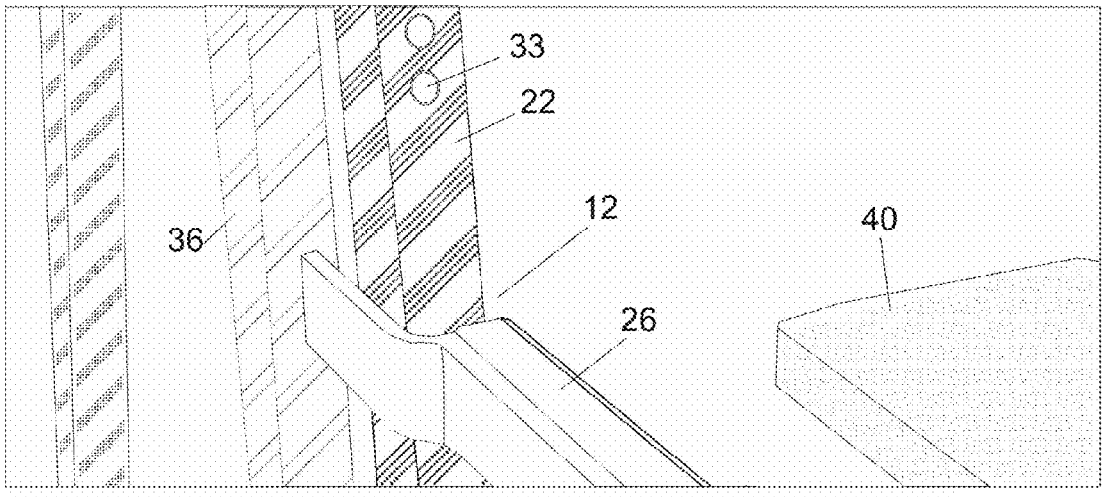
FIG. 8 shows an enlarged partial schematic view of a movable upright and an L-shaped end section of the supporting safety arm allowing for the upright to move to a proper lifting position.
Figure 8:
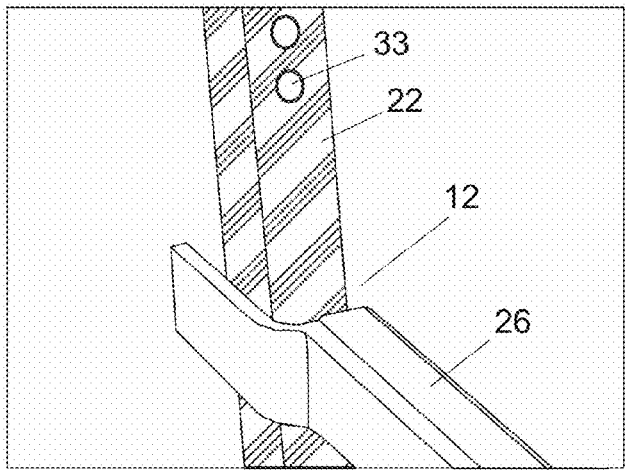

In one embodiment of the present invention, one end of the safety arms is provided with a U-shaped opening, 12, 14, as shown in FIG. 7. However, different designs can be provided to have the uprights and the safety arms in the same plane and allow for the uprights to move within the length of the safety arms. For example, the safety beams may be narrower and/or they may have an L-shaped ends as shown in FIG. 8.

Figure 10:
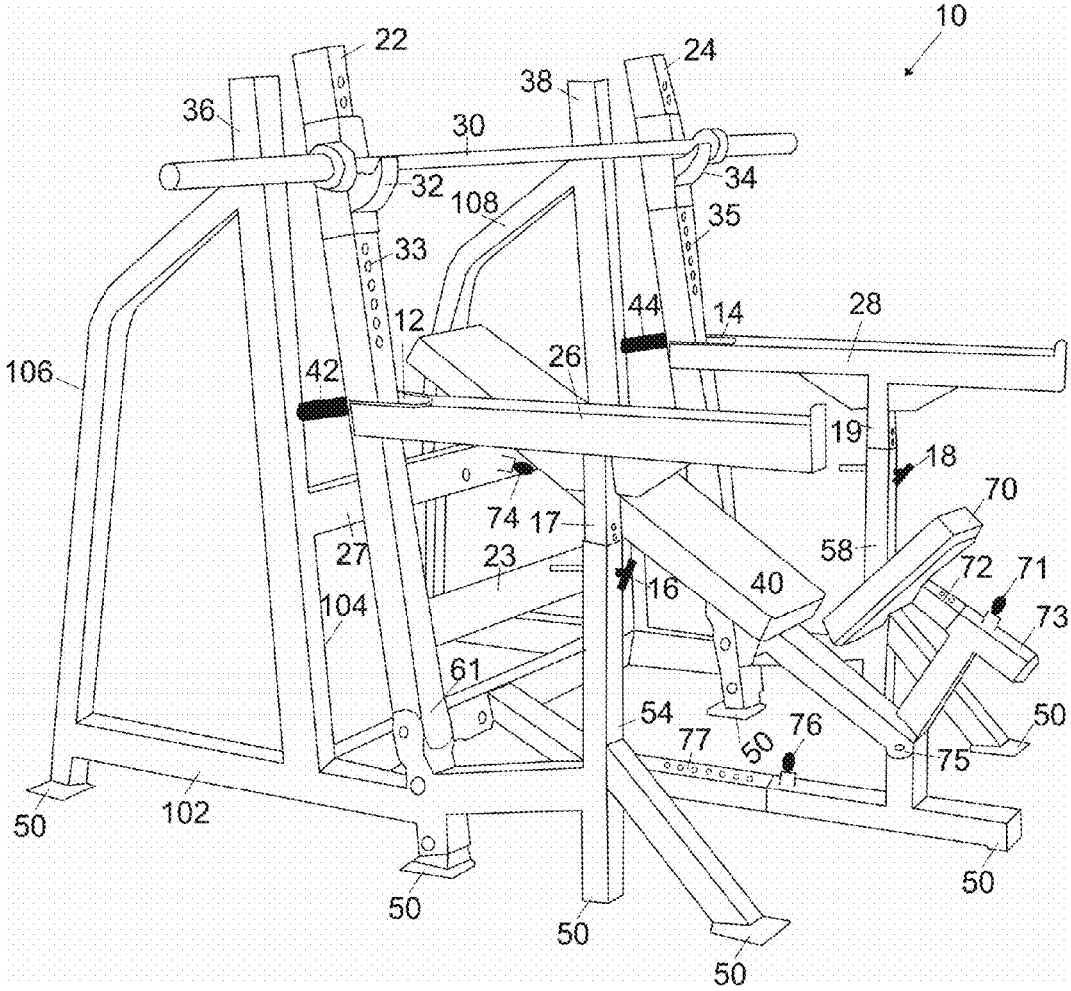
FIG. 10 shows an incline bench press embodiment of the present invention in the normal position.

In another embodiment of the present invention, the combined moving uprights and safety arms are utilized in an incline bench press as illustrated in FIG. 10. In an incline bench press, the bench 40 is inclined to elevate user's shoulders. The incline bench press is used to exercise the anterior deltoids and the upper of the pictorials major. The height of the seat 70 can be adjusted with a set of adjustable pins 71 and a telescoping leg 72, which is connected to a vertical leg 73. Also the height of the bench 40 can be adjusted using pin holes 74 on cross beam 27 and hinge 75. Furthermore the angle of the bench 40 can be changed up to 90 degree for shoulder press exercise with pin holes 76 on the telescopic beam 77.

Figure 11:
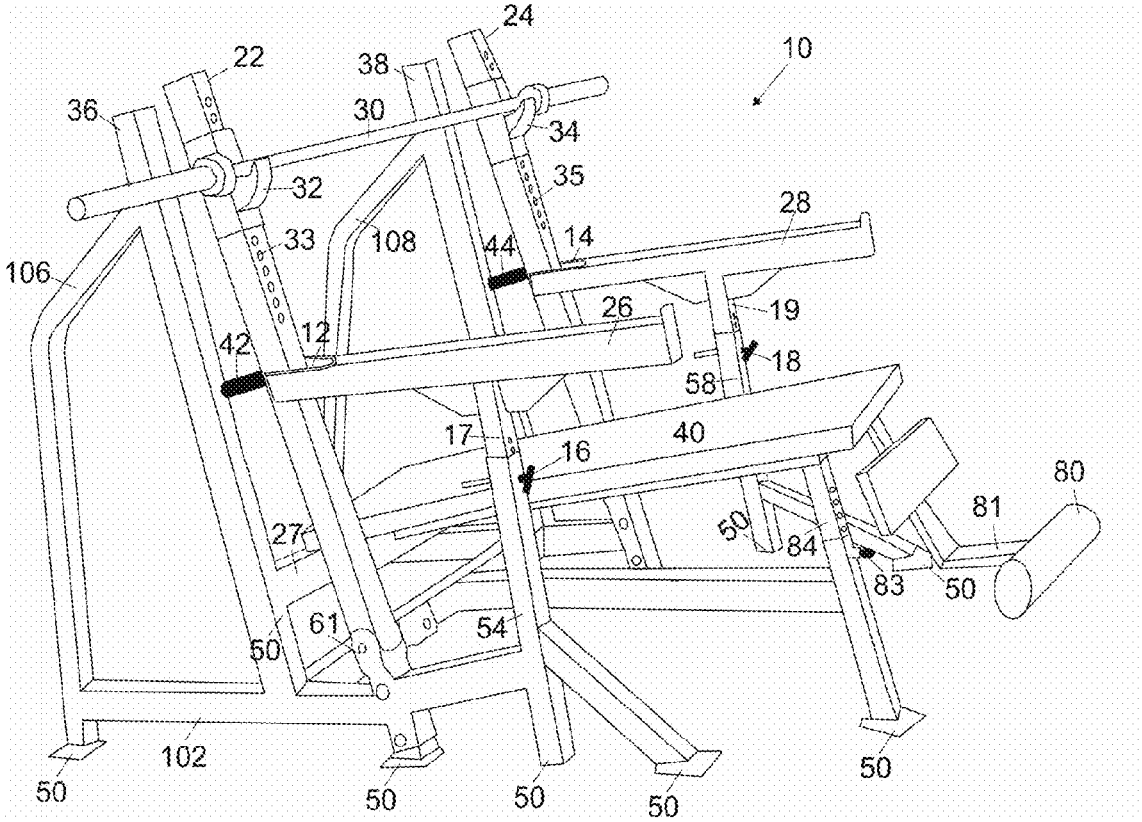
FIG. 11 shows a decline bench press embodiment of the present invention in the normal position.

In another embodiment of the present invention, the combined moving uprights and safety arms are utilized in a decline bench press as illustrated in FIG. 11. The bench 40 is declined to lower user's head and elevate the pelvis. This exercise works on the lower portion of the pectorals major. A foot support 80 is provided to allow the user to support him/herself in the decline position. The foot support 80 is connected to the bench 40 with an L-shaped beam 81. The height and angel of the decline bench 40 can be adjusted using pin holes 83 on telescopic beam 84.

All mechanism of the incline bench press and decline bench press are the same as flat bench press. Two moving uprights 22, 24 and two safety beams 26, 28 prevents falling the barbell 30 on the user. Also the stopping mechanism for limitation of movement of moving uprights 22, 24 are the same as flat bench press.

Figure 12:
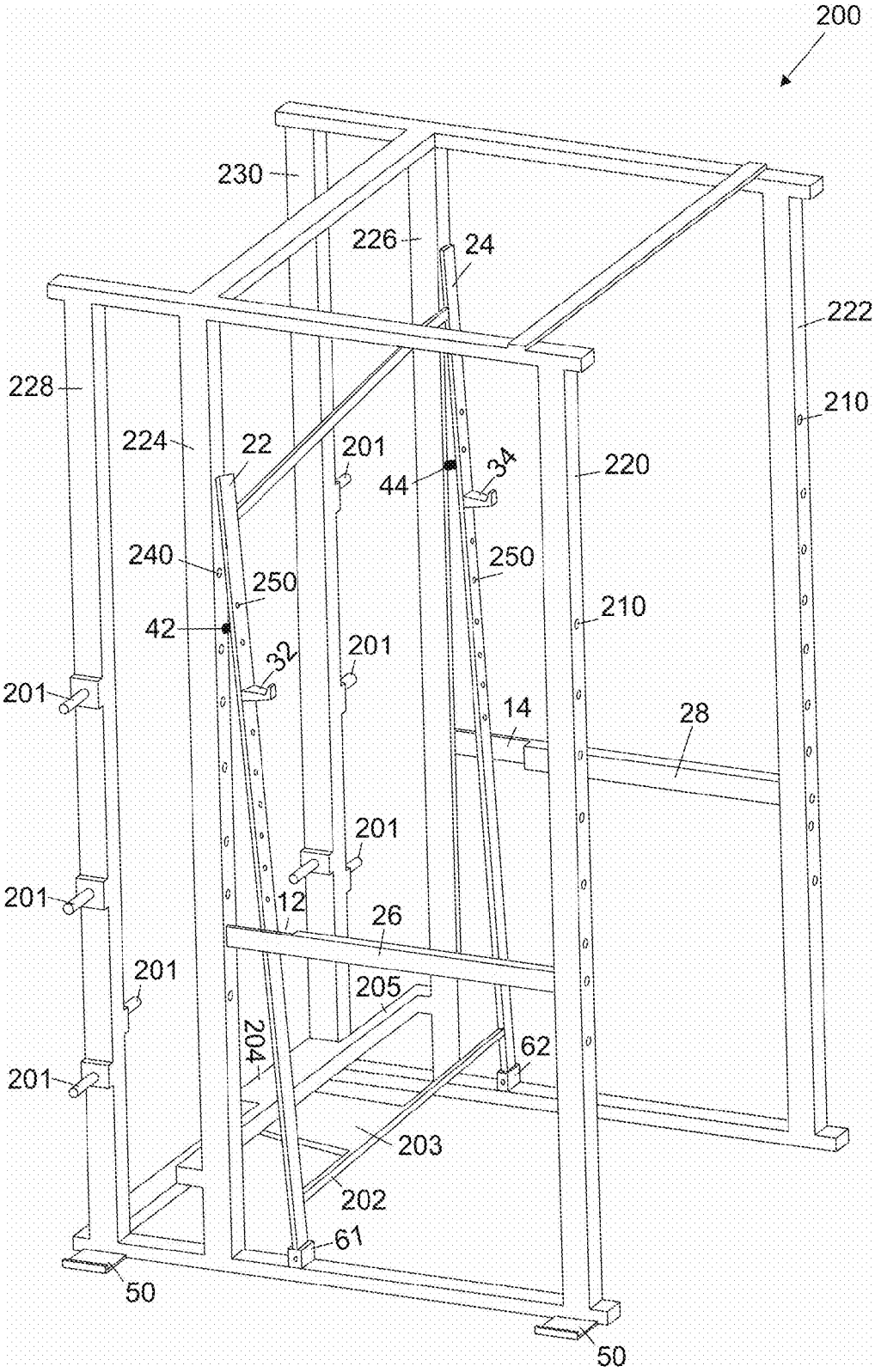
FIG. 12 shows a power rack embodiment of the present invention in the normal position.
Figure 13:
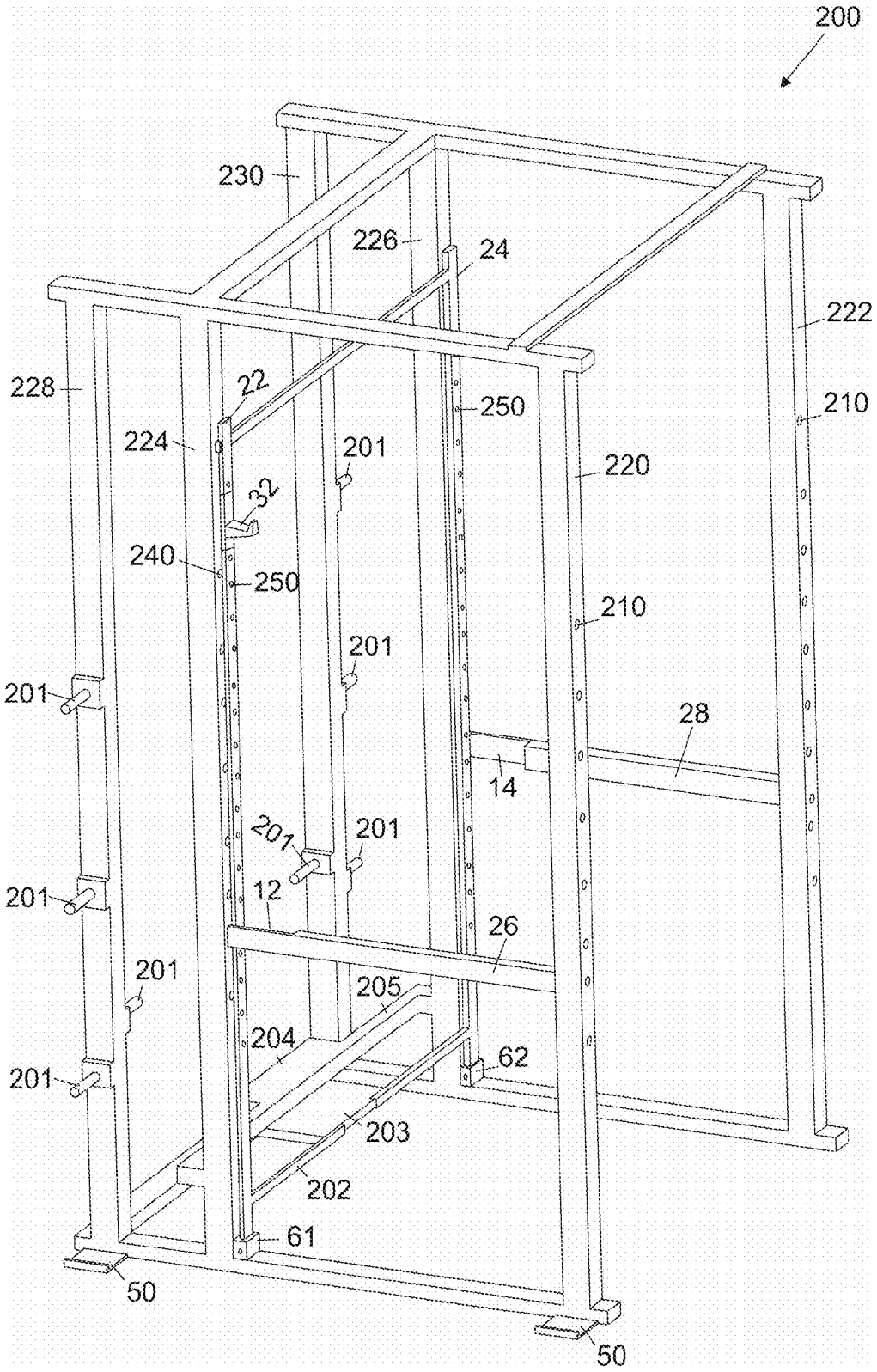
FIG. 13 shows a power rack embodiment of the present invention in normal position.

In another embodiment of the present invention, the combined moving uprights and safety arms are utilized in a power rack or a weight lifting cage as illustrated in FIGS. 12 and 13. Power rack is a safe free weight workout using a barbell without any movement restrictions imposed by the equipment. A power rack can be used for a wide variety of exercises. With a power rack a user can set the safety stops low enough that he or she can squad down and then stand up while holding the weight on the shoulders.

The safety features of the present invention, namely, movable uprights together with the safety arms being in one plane, are incorporated in a power rack 200 as illustrated in FIGS. 12 and 13. The power cage comprising of a set of front vertical bars and a set or rear vertical bars forming the cage. A set of stationary bars together with moving uprights are located inside the cage. One end of the safety arms 26 and 28 are provided with an L-shaped section, 12 and 14. The two movable uprights 22, 24 are pivotally connected to the stand using hinges 61 and 62. The pivoted vertical beams 22, 24 are located in front of the stationary beams 224, 226 and are designed to extend almost parallel to the stationary beams 224, 226. A cross beam 23 connecting the two pivoted vertical beams 22 and 24 is provided for both rigidity and as a counterweight.

The height of the safety arms 26, 28 can be adjusted using pin holes 210 on a first set of stationary vertical beams 220, 222 and pin holes 240 on the second set of stationary vertical beams 224, 226. Furthermore the location of the racks on the moving uprights 22, 24 can be adjusted using pin holes 250 on which the racks 32 and 34 are placed. Referring to FIGS. 12 and 13, the user can adjust the height of the barbell by moving the racks 32 and 34 and lock them in position using different pinholes 250.

Figure 14:
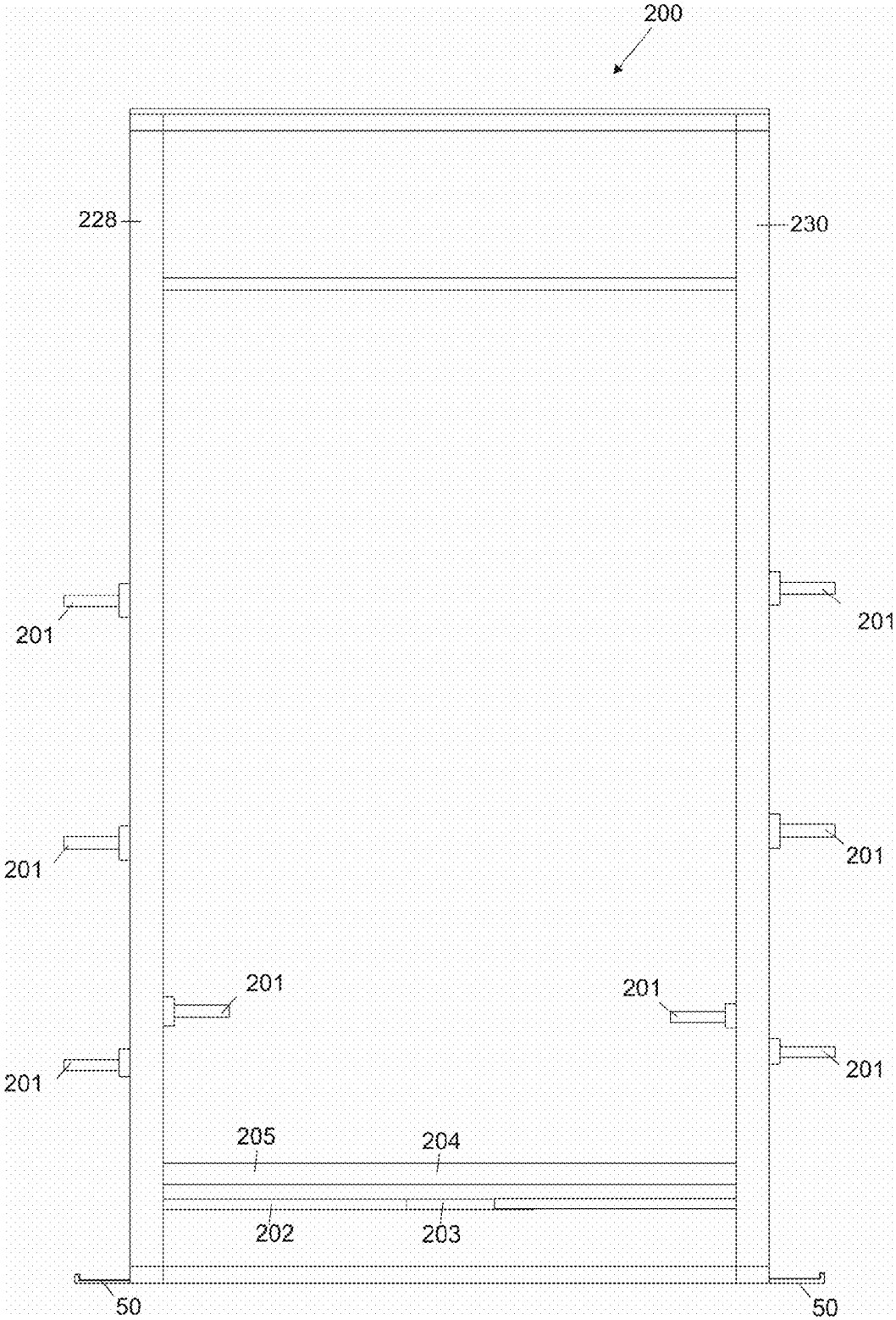
FIG. 14 shows the rear view of the power rack of the present invention with a stopping mechanism.

A stopper 203 as shown in FIGS. 12, 13 and 14, which is attached to the cross bar 202 is used to limit the movement of the moving uprights 22 and 24 in the forward direction and also to act as a counter weight to return of the moving uprights 22 and 24 from a substantially vertical position, back to their resting position. A set of rubber stoppers 42 and 44 (FIG. 12) attached to the stationary beams 36 and 38 limit the backward movement of the moving uprights 22 and 24.

In the normal position, the barbell with its weights is on the racks 32 and 34. A user moves the barbell forward while it is on the moving uprights 22, 24. The forward movement is stopped when the stopper 203 hits the cross beam 204. As soon as the barbell is lifted off its holding racks 32 and 34, the moving uprights 22 and 24 move back to the normal position due to the counterweight 203.

In another embodiment of the present power rack, the moving uprights 22 and 24 can be pivotally attached to the bottom of the stationary vertical beams 224 and 226, as shown in FIG. 13. The moving uprights will then tilt forward for use.

Plurality of weight holders 201 are provided on a set of third stationary vertical beams 228 and 230. The weights on the weight holders provide stability to the power rack 200 during the exercise.

Figure 15:
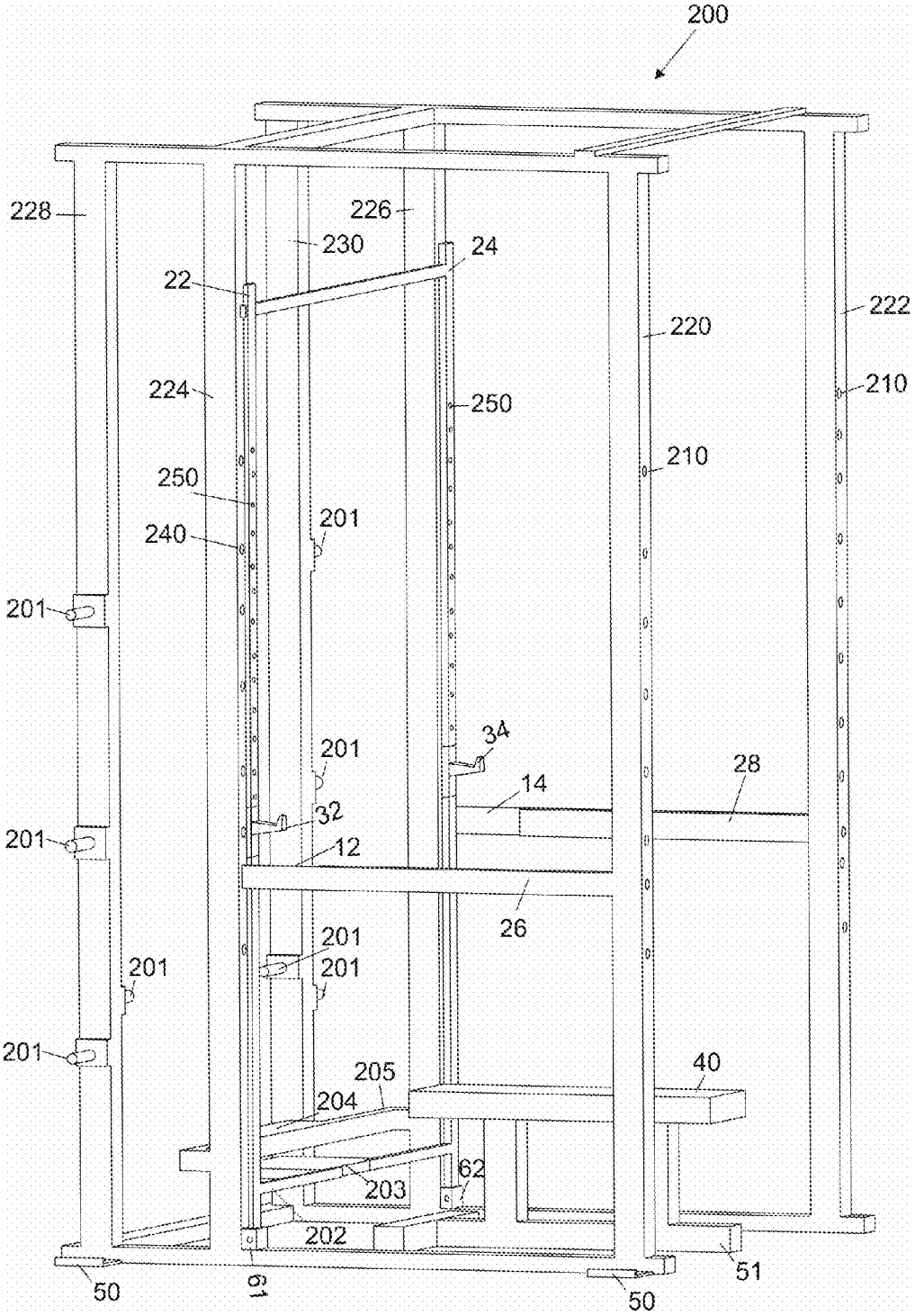
FIG. 15 shows a power rack embodiment of the present invention in a normal position together with a bench for bench press exercise.

In another embodiment of the present invention, the power rack 200 can be used as a bench press as shown in FIG. 15. A bench 40 is positioned in the middle of the stationary vertical beams 220, 222, 224 and 226. The user can set the safety arms 26 and 28 just above his/her chest and adjust racks 32 and 34 in a suitable position for doing bench press exercise. The bench 40 can be a horizontal bench, an incline bench or a decline bench.

Figure 16:
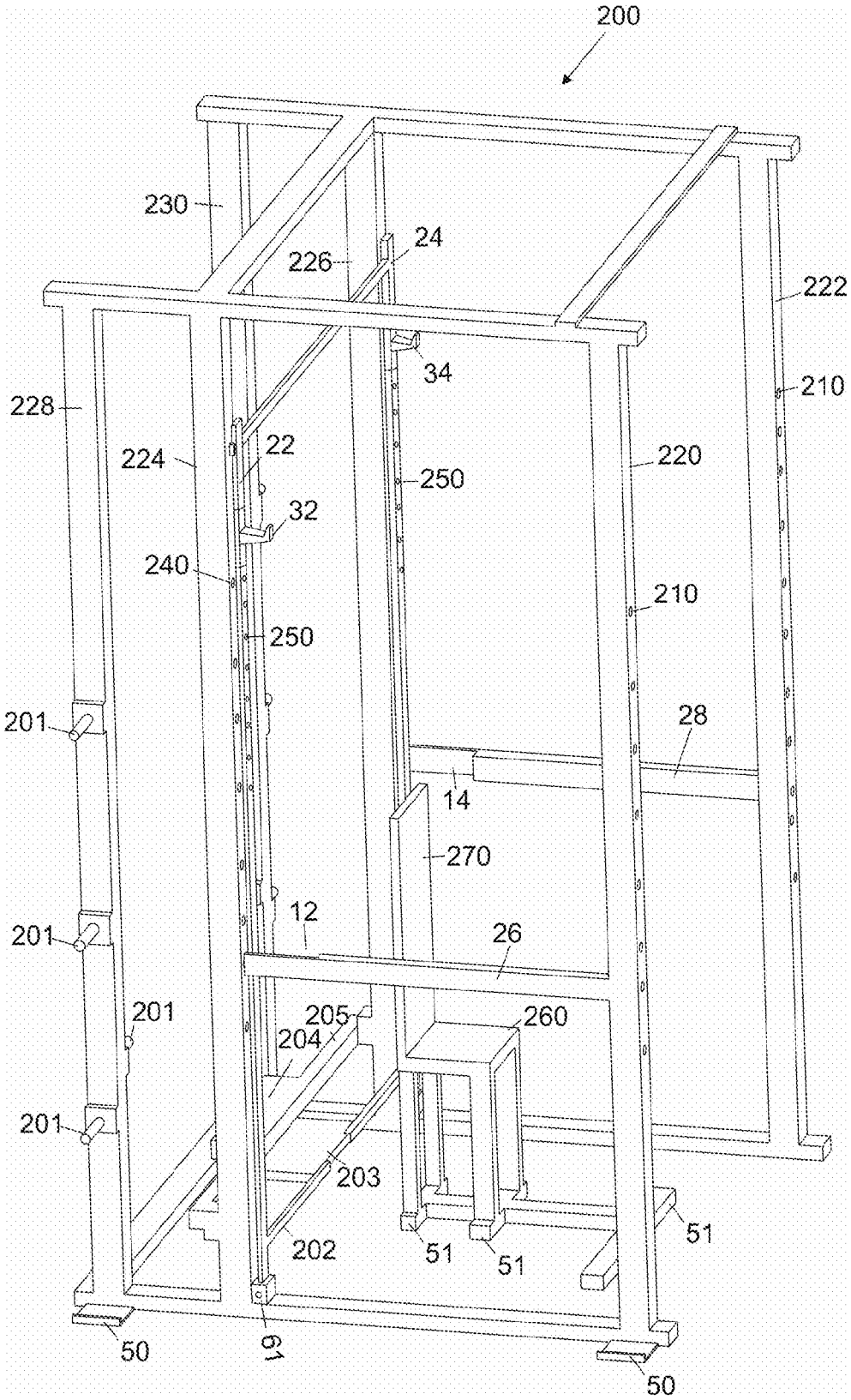
FIG. 16 shows a power rack embodiment of the present invention in a normal position together with a bench for shoulder press exercise.

In another embodiment of the present invention, the power rack 200 can be used as a shoulder press as shown in FIG. 16. The shoulder press involves pushing a barbell or a weight bar up above the head until the elbows are fully locked out. The shoulder press is a highly effective compound upper-body exercise. A bench 260 having a backing support 270 is located in the middle of the stationary vertical beams 220, 222, 224 and 226. A user can set the safety arms 26 and 28 just above his/her body while sitting on a seat 260 and adjust racks 32 and 34 in a suitable position for doing shoulder press exercise.

The bench press 10 and power rack 200 can be made of steel bars or other rigid materials and can have different beam and bar dimensions for rigidity. The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A safe bench press system, comprising:

a. a stand having a right and a left longitudinally extended beams with ground engaging legs to stably support said bench press system, wherein the spacing between said right and left beams defines the width of the stand;

b. a barbell having a grip length, wherein said width of the stand being at the most equal to the grip length of the barbell;

c. a first set of right and left stationary vertical beams rigidly connected to the stand;

d. a second set of right and left movable uprights pivotally connected to the stand;

e. a first cross beam connecting the stationary vertical beams for extra rigidity;

f. at least a second cross beam having a counter weight connecting the movable uprights;

g. said movable uprights having a set of holding racks with height adjusting means to hold the barbell, whereby said uprights tilt backward when the barbell is lifted off the racks;

h. a set of right and left horizontally extended safety arms located along the same plane defined by said movable uprights and stationary vertical beams;

i. said safety arms each having a proximal end and a distal end, i. said proximal end of the safety arm having means to engage with said movable uprights;

ii. said distal end having a lip to stop the movement of the barbell in case of an accident; and j. a bench placed in the middle of the said stationary vertical beams, said bench having a proximal end and a distal end, and being supported at its proximal end by said stationary cross beam and at its distal end having a ground engaging leg supporting the bench at a prespecified height from the ground.

2. The safe bench press system of claim 1, wherein said means to engage of the proximal end of the safety arms with said movable uprights being a U-shaped opening.

3. The safe bench press system of claim 1, wherein said means to engage of the proximal end of the safety arms with said movable uprights being an L-shaped opening.

4. The safe bench press system of claim 1, further having stopping means to limit the movement of said set of movable uprights.

5. The safe bench press system of claim 4, wherein said stopping means being a set of rubber stoppers having a prespecified length and connected to the top of the stationary vertical beams to prevent backward movement of the movable uprights and a set of stoppers connected to the first cross bar to engage with the second cross bar to limit the forward movement of the moveable uprights.

6. The safe bench press system of claim 1, wherein said safety arms further having telescopic height adjusting mechanism.

7. The safe bench press system of claim 1, wherein said movable uprights further having holding racks with height adjusting means, wherein said height adjusting means being a plurality of apertures with a pin to adjust the height of the holding racks on said movable uprights.

8. The safe bench press system of claim 1, wherein said bench press system being an incline bench press.

9. The safe bench press system of claim 1, wherein said bench press system being a decline bench press.

10. A safe power rack system, comprising:

a. a cage having a set of front vertical cage beams and a set of rear vertical cage beams, said cage beams defining a cage zone;

b. said rear vertical cage beams having plurality of weight holders;

c. a set of lower lateral beams and a set of upper lateral beams laterally connecting the front and the rear vertical cage beams, said lower lateral beams further having ground engaging legs to stably support said power rack, and wherein the spacing between each set of said lateral beams defines the width of the cage;

d. a weight bar having a grip length, wherein said width of the cage being at the most equal to the grip length of the weight bar;

e. a set of right and left stationary vertical beams within the cage zone and located between and substantially parallel to the vertical cage beams, said stationary vertical beams rigidly connected to said upper and lower lateral beams;

f. a set of right and left movable uprights pivotally connected to said lower lateral beams;

g. a first cross beam connecting the movable uprights for extra rigidity;

h. at least a second cross beam connecting the movable uprights and having a counterweight;

i. said movable uprights having a set of holding racks with height adjusting means to hold a weight bar;

j. a set of right and left horizontally extended safety arms extending from the front vertical cage beams to the stationary vertical beams; and k. said safety arms each having means to allow said movable uprights to freely move inside said arm, whereby, the movable uprights tilt rearward when the weight bar is lifted off the holding racks, clearly the space for a user to move the weight bar up and down.

11. The safe power rack system of claim 10, further having a bench placed within the cage zone, whereby said power rack is used as a bench press.

12. The safe power rack system of claim 10, wherein said means to allow said movable uprights to freely move inside said arm being a U-shaped opening.

13. The safe power rack system of claim 10, wherein said means to allow said movable uprights to freely move inside said arm being an L-shaped opening.

14. The safe power rack system of claim 10, further having stopping means to limit the movement of said set of movable uprights.

15. The safe power rack system of claim 14, wherein said stopping means being a set of rubber stopper having a prespecified length and connected to the top of the stationary vertical beams to prevent backward movement of the movable uprights and a set of stoppers connected to the first cross bar to engage with the second cross bar to limit the forward movement of the moveable uprights.

16. The safe power rack system of claim 10, wherein said safety arms further having height adjusting mechanism.

17. The safe power rack system of claim 10, wherein said movable uprights further having weight holding racks with height adjusting means, wherein said height adjusting means being a plurality of apertures with a pin to adjust the height of the holding rocks on said movable uprights.

18. The safe power rack system of claim 10, further having an incline bench placed within the cage zone, whereby said power rack is used as an incline bench press.

19. The safe power rack system of claim 11, further having a decline bench placed within the cage zone, whereby said power rack is used as a decline bench press.

20. The safe power rack system of claim 11, further having a shoulder bench placed within the cage zone, whereby said power rack is used as a shoulder bench press.

* * * * *